US007407019B2

(12) United States Patent
Kinder et al.

(10) Patent No.: US 7,407,019 B2
(45) Date of Patent: Aug. 5, 2008

(54) METHOD OF DYNAMICALLY CONTROLLING OPEN HOLE PRESSURE IN A WELLBORE USING WELLHEAD PRESSURE CONTROL

(75) Inventors: Joe Kinder, Houston, TX (US); Robert Graham, Great Yarmouth (GB)

(73) Assignee: Weatherford Canada Partnership, Edmonton (CA)

( * ) Notice: Subject to any disclaimer, the term of this patent is extended or adjusted under 35 U.S.C. 154(b) by 276 days.

(21) Appl. No.: 11/080,663

(22) Filed: Mar. 16, 2005

(65) Prior Publication Data

US 2006/0207795 A1 Sep. 21, 2006

(51) Int. Cl.
*E21B 21/08* (2006.01)

(52) U.S. Cl. ..... 175/38; 175/25

(58) Field of Classification Search ..... 175/38, 175/25, 57, 24, 48
See application file for complete search history.

(56) References Cited

U.S. PATENT DOCUMENTS 2,947,318 A * 8/1960 Odom ..... 137/122
3,470,971 A * 10/1969 Dower ..... 175/25
3,497,020 A 2/1970 Kammerer
3,534,822 A 10/1970 Campbell et al.
3,747,698 A 7/1973 Chapman
3,786,878 A 1/1974 Chapman
3,946,559 A * 3/1976 Stevenson ..... 60/413
3,970,335 A 7/1976 Curington
4,243,252 A 1/1981 Johnson
4,565,086 A * 1/1986 Orr, Jr. ..... 73/19.09
4,887,464 A * 12/1989 Tannenbaum et al. .... 73/152.04
5,355,967 A 10/1994 Mueller
5,586,609 A 12/1996 Schuh
5,720,356 A 2/1998 Gardes
5,865,261 A 2/1999 Cooper
5,873,420 A 2/1999 Gearhart
6,065,550 A 5/2000 Gardes (Continued)

FOREIGN PATENT DOCUMENTS

WO WO2005/017308 2/2005

OTHER PUBLICATIONS

UK Search Report in Connection With Foreign Application Corresponding to the Above Identified US Patent Application.

(Continued)

*Primary Examiner*—Jennifer H Gay
*Assistant Examiner*—Daniel P Stephenson
(74) *Attorney, Agent, or Firm*—Merek, Blackmon & Voorhees, LLC

(57) ABSTRACT

A method of dynamically controlling open hole pressure within a wellbore having a drill string positioned therein. The method comprising the steps of pumping a fluid down the drill string, into an annulus formed by the drill string and the interior of the wellbore, and then subsequently up the annulus to the surface of the ground; selectively applying wellhead pressure to the annulus through selectively pumping an additional quantity of the fluid or a quantity of a secondary fluid across the annulus; and, controlling the application of wellhead pressure applied to the annulus by controlling one, or both, of (a) the operation of a wellhead pressure control choke, and (b) the flow rate of the additional quantity of fluid or the secondary fluid pumped across the annulus, to thereby maintain open hole pressure within a desired range.

31 Claims, 8 Drawing Sheets

U.S. PATENT DOCUMENTS

| | | | | |
|---|---|---|---|---|
| 6,352,129 | B1 | 3/2002 | Best | |
| 6,374,925 | B1 * | 4/2002 | Elkins et al. | 175/25 |
| 6,415,877 | B1 | 7/2002 | Fincher et al. | |
| 6,457,540 | B2 | 10/2002 | Gardes | |
| 6,527,062 | B2 * | 3/2003 | Elkins et al. | 175/25 |
| 6,607,042 | B2 | 8/2003 | Hoyer | |
| 6,904,981 | B2 * | 6/2005 | van Riet | 175/66 |
| 6,920,942 | B2 * | 7/2005 | Koederitz | 175/25 |
| 7,037,408 | B2 * | 5/2006 | Wilborn et al. | 201/2 |
| 7,044,239 | B2 * | 5/2006 | Pinckard et al. | 175/57 |
| 7,134,489 | B2 | 11/2006 | Van Riet | |
| 7,185,719 | B2 * | 3/2007 | van Riet | 175/66 |
| 2002/0007968 | A1 * | 1/2002 | Gardes | 175/57 |
| 2002/0011333 | A1 | 1/2002 | Ward | |
| 2002/0066571 | A1 | 6/2002 | Schubert et al. | |
| 2002/0108783 | A1 * | 8/2002 | Elkins et al. | 175/25 |
| 2002/0112888 | A1 * | 8/2002 | Leuchtenberg | 175/48 |
| 2003/0024737 | A1 * | 2/2003 | Chang et al. | 175/25 |
| 2003/0079912 | A1 | 5/2003 | Leuchtenberg | |
| 2003/0168258 | A1 * | 9/2003 | Koederitz | 175/38 |
| 2003/0196804 | A1 * | 10/2003 | Riet | 166/267 |
| 2004/0065440 | A1 | 4/2004 | Farabee et al. | |
| 2004/0144565 | A1 * | 7/2004 | Koederitz | 175/25 |
| 2004/0178003 | A1 * | 9/2004 | Riet | 175/57 |
| 2004/0238180 | A1 | 12/2004 | McGee | |
| 2006/0086538 | A1 | 4/2006 | Riet | |

OTHER PUBLICATIONS

Uk Patent Application, No. 2323870, Oct. 7, 1998.
PCT Published Application No. WO 99/49172, Sep. 30, 1999.
PCT Published Application No. WO 00/75477, Dec. 14, 2000.
PCT Published Application No. WO 00/4269, Jan. 27, 2000.
PCT Published Application No. WO 99/42696, Aug. 26, 1999.

* cited by examiner

METHOD OF DYNAMICALLY CONTROLLING OPEN HOLE PRESSURE IN A WELLBORE USING WELLHEAD PRESSURE CONTROL

FIELD OF THE INVENTION

This invention relates to a method of controlling open hole pressure in a wellbore while drilling through underground formations. In one of its embodiments the invention pertains to a method of dynamically controlling open hole pressure through the use of wellhead pressure control.

BACKGROUND OF THE INVENTION

Common methods of drilling wells from the surface down through underground formations employ the use of a drill bit that is rotated by either a downhole motor (sometimes referred to as a mud motor), through rotation of a drill string extending from the surface, or through a combination of both surface and downhole drive mechanisms. Where a downhole motor is utilized, energy is typically transferred from the surface to the downhole motor by pumping a drilling fluid or "mud" down through a drill string and channeling the fluid through the motor causing the rotor of the downhole motor to rotate and drive the rotary drill bit. The drilling fluid or mud serves the further function of entraining rock cuttings and circulating them to the surface for removal from the well. In some instances the drilling fluid may also help to lubricate and cool the drill bit and other downhole components.

When drilling for oil and gas there are many instances where the underground formations that are encountered contain fluid (generally water, oil or gas) at very high pressures. Traditionally, when drilling into such formations a high density drilling fluid or mud is utilized in order to provide a high hydrostatic pressure within the wellbore to counteract the high fluid pressure. In such cases the hydrostatic pressure of the mud meets or exceeds the underground fluid pressure thereby ensuring well control and preventing a potential blowout. Where the hydrostatic pressure of the drilling mud is approximately the same as the underground fluid pressure, a state of balanced drilling is achieved. Due to the potential danger of a blowout in high pressure wells, in most instances an overbalanced situation is desired with the hydrostatic head of the drilling mud exceeding the underground formation pressure by a predetermined safety factor. The high density mud and the high hydrostatic head that it creates also helps to prevent a blowout in the event that a sudden fluid influx or "kick" is experienced when drilling through a particular underground formation that is under very high pressure, or when first entering a high pressure zone.

Unfortunately, such prior systems that employ high density drilling muds to counterbalance the effects of high formation pressures have met with only limited success. In order to create a sufficient hydrostatic head, the density of the drilling mud often has to be relatively high (for example from 15 to 25 pounds per gallon), necessitating the use of costly density enhancing additives. Such additives not only significantly increase the cost of the drilling operations, but can also present environmental difficulties in terms of their handling and disposal. High density muds may also not be compatible with many standard surface separation systems that are commonly in use. In typical surface separation systems the high density solids are removed preferentially to the drilled solids and the mud must be re-weighted to ensure that the desired density is maintained before it can be pumped back into the well.

High density drilling muds also present an increased potential for plugging downhole components, particularly where the drilling operation is unintentionally suspended due to mechanical, electrical, hydraulic or other failure. In addition, the high hydrostatic pressure created by the column of drilling mud in the string often results in a portion of the mud being driven into the formation, requiring additional fresh mud to be continually added at the surface and thereby further increasing costs. Invasion of the drilling mud into the subsurface formation may also cause irreparable damage to the formation.

Another limitation of such prior well pressure systems concerns the degree and level of control that may be exercised over the well. The hydrostatic pressure applied to the wellbore is primarily a function of the density of the mud and its depth or column height. For that reason there is only a limited ability to alter the hydrostatic pressure applied to the formation. Generally, varying the hole pressure requires an alteration of either the density of the drilling mud or the drilling fluid injection rate. The former can be an expensive and time consuming process, and the latter is limited and not always practical since it may have an adverse affect on the ability to clean the hole.

As a means to address some of the above deficiencies, others have suggested pumping fluids into the annulus of the well to thereby control bottom hole circulating pressure through controlling friction pressure. Such a method is described in U.S. Pat. No. 6,607,042, dated Aug. 19, 2003. While friction pressure methods of this sort may be effective in controlling bottom hole pressure, they can also increase the level of complexity of the overall drilling process, and necessitate the use of additional equipment that can have the result of increasing both capital and operating costs.

Still others have suggested controlling bottom hole pressure through the use of a surface back pressure system. Typically, such systems involve continuously monitoring borehole pressure to create a pressure model that is then used to predict fluctuations in downhole pressure. The model is continuously updated through the use of a computer or microprocessor that receives signals from downhole pressure sensors, flow meters and other such devices. The pressure model is then in turn used to control wellhead back pressure. Such a method is described in United States patent application publication number U.S. 2003/0196804, dated Oct. 23, 2003. As in the case of friction pressure systems, current surface back pressure systems add a significant level of complexity to the drilling operations, necessitate the use of additional equipment, and to a large extent are dependent upon the accuracy and predictability of a constantly changing downhole pressure model. Neither friction pressure nor currently available surface back pressure systems are designed to specifically counteract the effects of surge and swab pressures caused by the movement of the drill string.

SUMMARY OF THE INVENTION

The invention therefore provides a method of dynamically controlling open hole pressure in a wellbore that addresses a number of limitations in the prior art. In particular, the method of the present invention provides a simplified, efficient and relatively inexpensive manner to dynamically control open hole pressure during a drilling operation through the application of wellhead pressure.

Accordingly, in one of its aspects the invention provides a method of dynamically controlling open hole pressure within a wellbore having a drill string positioned therein, the method comprising the steps of (i) pumping a fluid down the drill string, into an annulus formed by the drill string and the interior of the wellbore, and then subsequently up the annulus to the surface of the ground; (ii) selectively applying wellhead pressure to the annulus through selectively pumping an additional quantity of the fluid or a quantity of a secondary fluid across the annulus; and, (iii) controlling the application of wellhead pressure applied to the annulus by controlling one, or both, of (a) the operation of a wellhead pressure control choke, and (b) the flow rate of the additional quantity of fluid or the secondary fluid pumped across the annulus, to thereby maintain open hole pressure within a desired range.

In another aspect the invention provides a method of controlling open hole pressure in a wellbore having positioned therein a drill string through which fluid is pumped down into the wellbore, the method comprising the steps of (i) selectively applying wellhead pressure to the annulus formed by the drill string and the interior of the wellbore by selectively pumping an additional quantity of the fluid or a quantity of a secondary fluid across the annulus; (ii) accommodating surge effects created when the drill string is advanced within the wellbore by decreasing the rate of pumping fluid down the drill string; and, (iii) accommodating swab effects created when the drill string is lifted within the wellbore by increasing the rate of pumping fluid down the drill string.

The invention also concerns a method of controlling open hole pressure in a wellbore having positioned therein a drill string through which fluid is pumped down into the wellbore, the method comprising the steps of (i) selectively applying wellhead pressure to the annulus formed by the drill string and the interior of the wellbore by selectively pumping an additional quantity of the fluid or a quantity of a secondary fluid across the annulus; (ii) accommodating surge effects created when the drill string is advanced within the wellbore through decreasing the wellhead pressure applied across the annulus; and, (iii) accommodating swab effects created when the drill string is lifted within the wellbore through increasing wellhead pressure applied across the annulus.

In another aspect the invention provides a method of dynamically controlling open hole pressure within a wellbore, the wellbore having therein a drill string through which a fluid is pumped down into the wellbore, the method comprising the steps of selectively applying wellhead pressure to the annulus formed by the drill string and the interior of the wellbore by selectively pumping a quantity of said fluid or a secondary fluid across the annulus; controlling the application of wellhead pressure applied to the annulus by controlling one, or both, of (a) the operation of a wellhead pressure control choke, and (b) the flow rate of the fluid or secondary fluid pumped across the annulus; and, providing a means for the application of a fixed and elevated level of wellhead pressure to the annulus to cause an increase in the open hole pressure by a fixed and pre-determined percentage or amount.

In a further aspect the invention concerns a method of dynamically controlling open hole pressure within a wellbore having therein a drill string through which a fluid is pumped down into the wellbore, the method comprising the steps of selectively applying pressure to the annulus formed by the drill string and the interior of the wellbore by selectively pumping a quantity of said fluid or a secondary fluid across the annulus; controlling the application of pressure applied to the annulus by controlling one, or both, of (a) the operation of a pressure control choke, and (b) the flow rate of the fluid or secondary fluid pumped across the annulus; increasing the level of applied pressure to give the effect of a higher density fluid being pumped down the drill string; and, monitoring wellbore conditions to determine the effective result of pumping a higher density fluid down the drill string without an actual change in the density of the fluid.

In addition, the invention also relates to a method of dynamically controlling open hole pressure within a wellbore having therein a drill string through which a fluid is pumped down into the wellbore, the method comprising the steps of controlling the application of a wellhead pressure applied to the annulus formed by the drill string and the interior of the wellbore; increasing the level of applied wellhead pressure to give the effect of a higher density fluid being pumped down the drill string; and, monitoring wellbore conditions to determine the effective result of pumping a higher density fluid down the drill string without an actual change in the density of the fluid.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. The specification and drawings that follow describe and disclose only some of the specific forms of the invention and are not intended to limit the scope of the invention as defined in the claims that follow herein.

The method of controlling open hole pressure according to the present invention in one aspect generally involves controlling the effective hole pressure gradient by replacing or augmenting the frictional component of hole pressure with wellhead or back pressure. Open hole pressure can be defined mathematically by the following general relationship:

$P_{OH}=P_{Hyd}+P_{Fric}+P_{WH}$; where, $P_{OH}$ is open hole pressure;

$P_{Hyd}$ is hydrostatic pressure;

$P_{Fric}$, is friction pressure; and, $P_{WH}$ is wellhead pressure.

Figure 1:
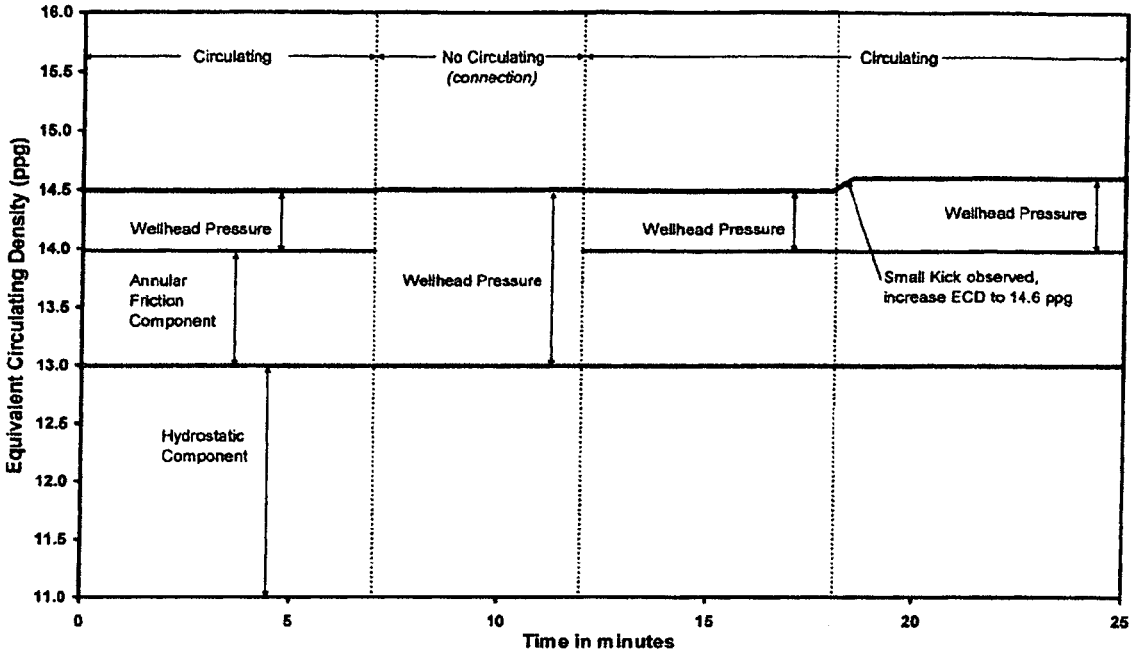
FIG. 1 is a graph that depicts various components of hole pressure that may be experienced by a wellbore over time, in a circulating and a non-circulating environment, as a function of an equivalent circulating mud density.

In FIG. 1 there is shown graphically the relationship between hole pressure, hydrostatic pressure, friction pressure and wellhead pressure in the case of a circulating and non-circulating well. As indicated in the graph, during situations of non-circulation some form of pressure or hydrostatic head must be applied to the well to compensate for the loss of a friction pressure component. The hydrostatic head should also be sufficient to contain the well in the event of a pump failure.

In the present invention, and as indicated in FIG. 1, the loss of friction pressure may be offset through the application of wellhead pressure. When there is circulation the wellhead pressure component may be reduced to account for the effects of friction pressure in the circulating fluid. As also indicated in FIG. 1, where the well experiences a "kick" or a sudden influx of hydrocarbons or other fluids the wellhead pressure component should normally be increased to compensate for the higher downhole pressures and in order to maintain the desired open hole condition. Control of open hole pressure is at this point largely dependent upon using surface drill string injection pressure (standpipe pressure) as the feedback mechanism while the "kick" or influx is circulated out. Such a procedure is referred to as "Driller's Method" in conventional well control. Standpipe pressure is used here as the feedback mechanism since the fluid in the string is a known commodity with known properties, whereas the fluid in the drill string/casing annulus contains the influx and has, to a large extent, undetermined physical properties.

Figure 2:
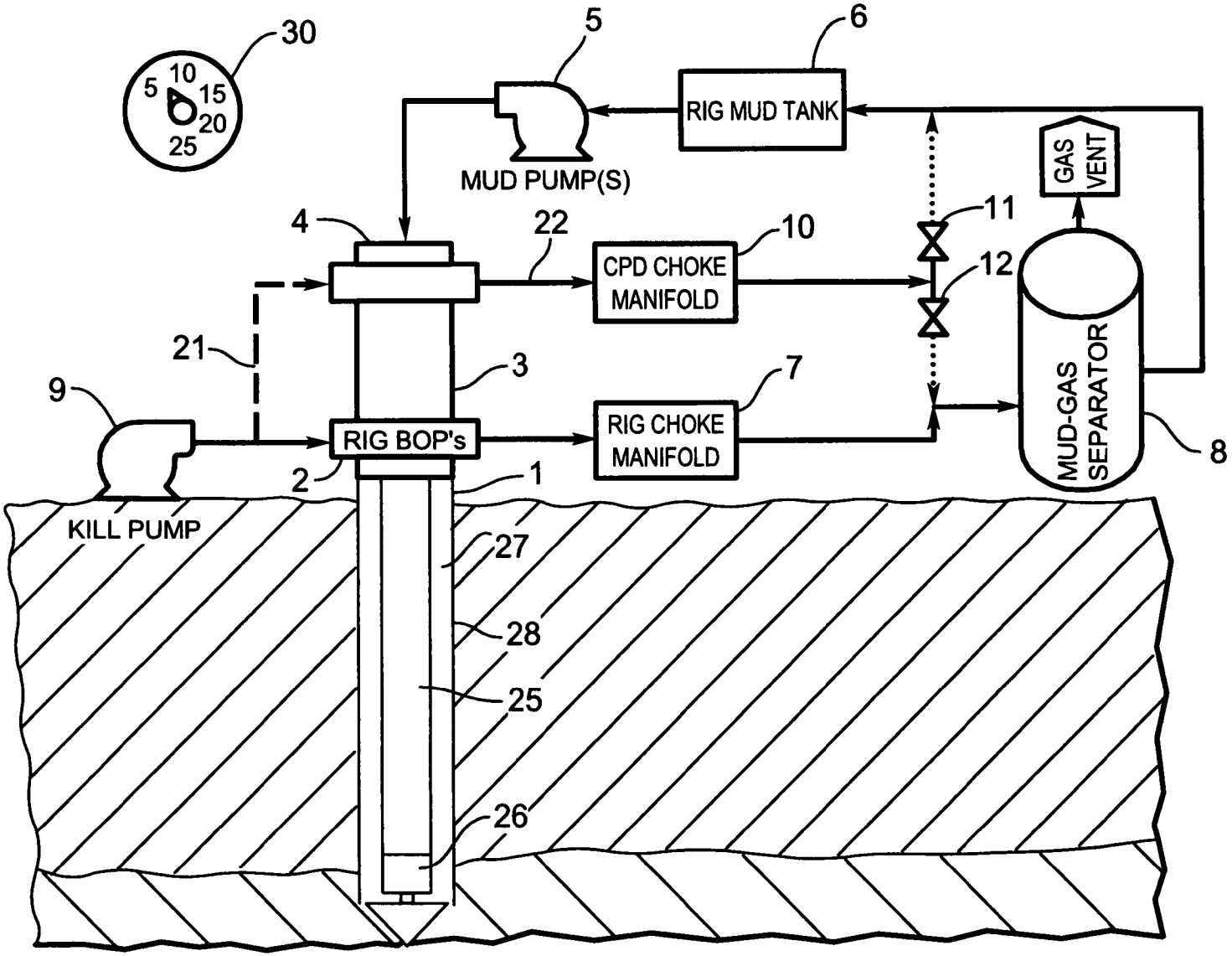
FIG. 2 is a schematic flow diagram depicting the application of one of the preferred embodiments of the present invention.
Figure 3:
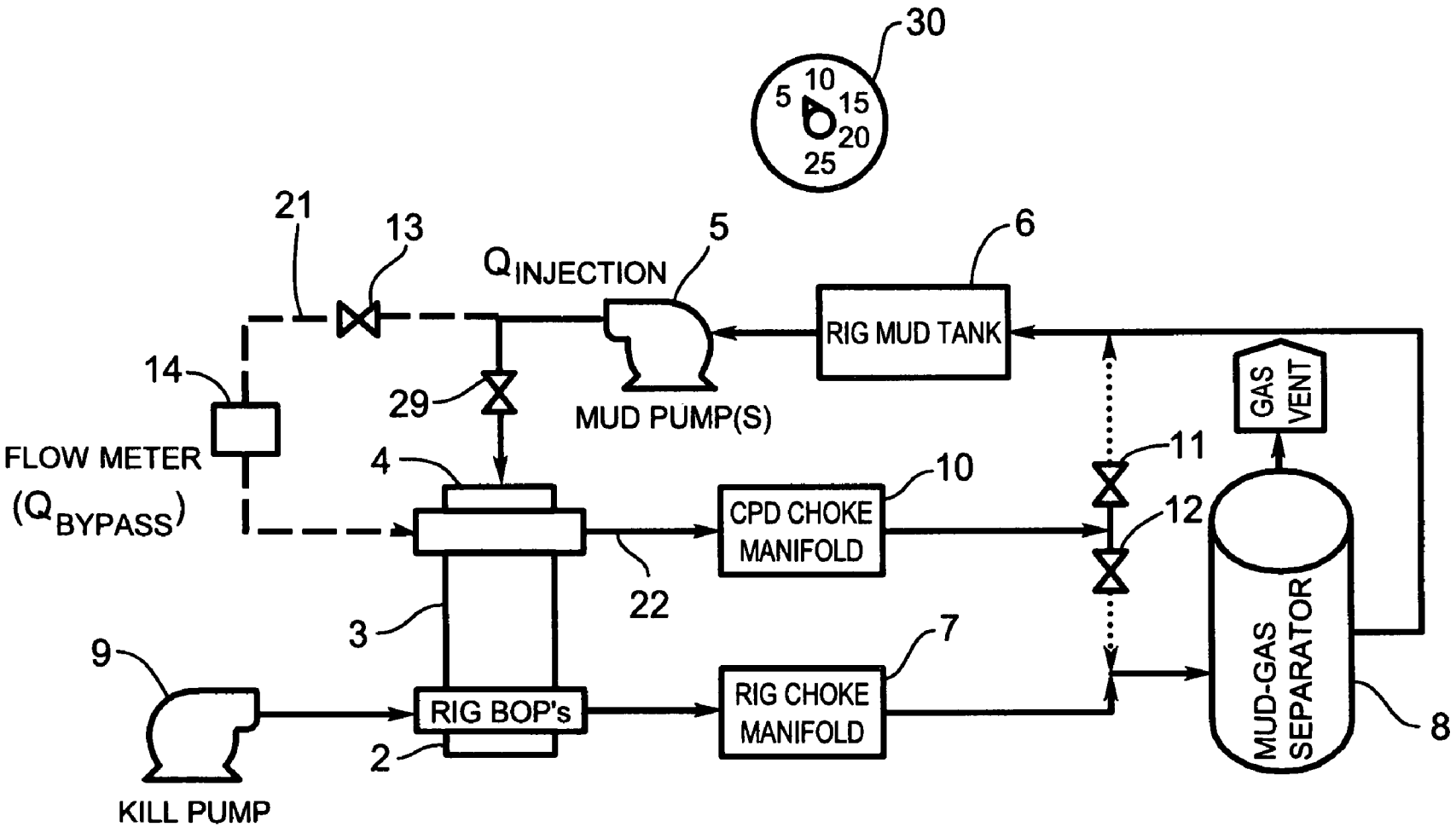
FIG. 3 is a schematic flow diagram depicting the application of an alternate embodiment of the present invention.

FIGS. 2 and 3 are schematic flow diagrams depicting two alternate wellhead set ups that could be utilized in order to develop, control and maintain wellhead pressure as a means to maintain open hole pressure within a desired range. In both instances there is shown a relatively generic wellhead 1 that includes a rig blowout preventor 2, a standpipe 3, and a rotating blowout preventor 4. One or more mud pumps 5 draw drilling fluid or mud from a rig tank 6 and inject the fluid into a drill string 25. The drilling fluid is pumped down the drill string, through the drill bit assembly 26, and back up the annulus 27 between the string and casing 28, carrying with it entrained cuttings. As the fluid exits the well it passes through a rig choke 7. After passing through choke 7 the drilling fluid is sent to a separator 8 where gas, oil, water and solid components can be separated with the "cleaned" mud returned to the rig tank for re-injecting into the well. In most drilling applications there will also be provided an auxiliary pump 9 designed to inject drilling mud or other fluid into the well in order to place and maintain the well in an overbalanced state. The auxiliary pump may be activated in the event of an equipment failure or any other loss of circulation which could result in a corresponding loss of well control. In some instances the auxiliary pump may comprise what is often referred to as a "kill" pump.

In accordance with one of the preferred embodiments of the invention the wellhead equipment further includes a pump to produce the necessary kinetic energy to provide wellhead or back pressure across the annulus. In the particular embodiment shown in FIG. 2, auxiliary or kill pump 9 is used as the wellhead pressure pump since it is already connected to the rig mud tank and is tied into the wellbore annulus below the rotating blow out preventor. However, it should also be appreciated that a separate dedicated pump could be used in place of the auxiliary pump. As shown schematically in FIG. 2, a fluid supply line 21 from auxiliary pump 9 delivers pressurized fluid to the wellhead and across annulus 27. Fluid exits the wellhead through discharge line 22 within which there is placed a wellhead pressure control choke 10 having an adjustable orifice. Accordingly, through the operation of choke 10 wellhead pressure will be applied across the annulus by the fluid from the auxiliary pump. The operation of the blow out preventor and choke 10 can thus control the circulation of fluid out of the well to accommodate well conditions at hand. The rate or volume of fluid injected by auxiliary pump 9 may be monitored by means of a stroke counter on the pump, or through a flow meter (not shown) installed within fluid supply line 21, to ensure that there is sufficient flow to compensate for well losses. For a known rate of fluid injection the orifice in choke 10 can thus be adjusted to vary the amount of wellhead pressure added to the annulus and to thereby alter the effective mud weight and maintain the pressure of the open hole below the shoe within a desired range.

The fluid that exits wellhead pressure control choke 10 may be sent either back to the rig tank 6 or to separator 8, depending upon the particular conditions at hand. Preferably a pair of valves, 11 and 12, are situated in the fluid discharge line to enable either the rig operator or an automated system to direct the flow of the fluid as it passes out of choke 10. Under normal or routine conditions valve 11 will be open and valve 12 closed so that fluid from the choke will be directed to the drilling rig's normal mud cleaning system and then returned to tank 6. In other cases the mud flow should be diverted from the mud cleaning system and directed to a gas removal system. For example, should the well experience an influx or a "kick", or should excessive gas be detected in the rig's mud tanks, valve 12 would typically be opened with valve 11 closed to force all fluids from the well to pass through separator 8. To prevent the flow of mud simultaneously through both paths, valves 11 and 12 are preferably interlocked with only one valve open at a given time. It will be understood by those skilled in the art that in practice valves 11 and 12 may be comprised of a multiplicity of diverter valves that direct the flow of returns downstream of the choke. Where the operation of valves 11 and 12 is automated the rig's mud logger or a similar system could be monitored for the presence of gas. When gas is detected, a mud flow path that diverts the mud to the gas removal system could be automatically selected (with the interlock preventing further flow of gas-laden effluent to the rig's open mud system). When the gas is circulated out, normal flow could be automatically re-established with the mud once again directed to the mud cleaning system and the rig tanks. The interlocking of the diverter valves 11 and 12 may be through the use of electronic, hydraulic, or mechanical means.

FIG. 3 shows a flow diagram that is slightly different from that of FIG. 2 wherein the fluid injected for purposes of wellhead pressure control is obtained directly from mud pump 5. Under this wellhead configuration a portion of the drilling fluid from mud pump 5 (or from a bank of mud pumps if more than one is being used) is diverted prior to being injected down the drill string and is instead injected through a supply line 21, across the wellhead to create wellhead or back pressure. As in the case of the embodiment shown in FIG. 2, a wellhead pressure control choke 10, positioned within a discharge line 22, restricts the flow of the by-pass fluid and establishes a wellhead or back pressure upon the well. The embodiment shown in FIG. 3 also employs valves 11 and 12 in order to direct the fluid from choke 10 to either the rig tank 6 or through separator 8, in the same manner as described above. Mud supply valves 13 and 29 are used to control the syphoning of drilling fluid from the mud pumps and its injection across the wellhead. It will be appreciated that as valve 13 is closed to reduce the volume of fluid injected across the wellhead, valve 29 should be opened to direct more fluid down the drill string. In order to determine the volume of fluid that is pumped down the drill string a flow meter 14 is preferably utilized to measure the bypass flow volume.

In both of the embodiments shown in FIGS. 2 and 3, it is preferable for valve 11 to be biased to a normally closed position so that in the event of the loss of pneumatic pressure or other source of control, valve 11 would fail to a closed position that diverts all fluids from the well through separator 8. Of course, to accomplish this not only should valve 11 fail to a closed position, but valve 12 should be constructed to fail to an open position. In this manner the potential for the unobstructed escape of hydrocarbons, or the mixing of hydrocarbons with drilling fluid in the rig tank, is minimized.

Under one aspect of the invention the amount of wellhead or back pressure applied to the well is determined by operating choke 10 at one of two pre-determined or set-points; namely, a circulating point or "set-point 1" (SP1) and a non-circulating point or "set-point 2" (SP2). Set-point 1 may be defined as a wellhead pressure that is desired during circulation to give the effect of a higher equivalent mud weight. The wellhead pressure may be zero or may have some positive value to bridge the gap between the actual mud weight and the desired effective mud weight. The second set point, or set-point 2, will be the sum of SP1 and the wellhead pressure required to replace the loss of friction pressure when circulation has stopped. In these regards it will be appreciated that while the friction pressure associated with circulation is generally a function of fluid rheology, wellbore geometry and flow rate, since fluid rheology and wellbore geometry are fairly constant it is the flow rate that is usually the most significant independent variable affecting friction pressure.

Figure 4A:
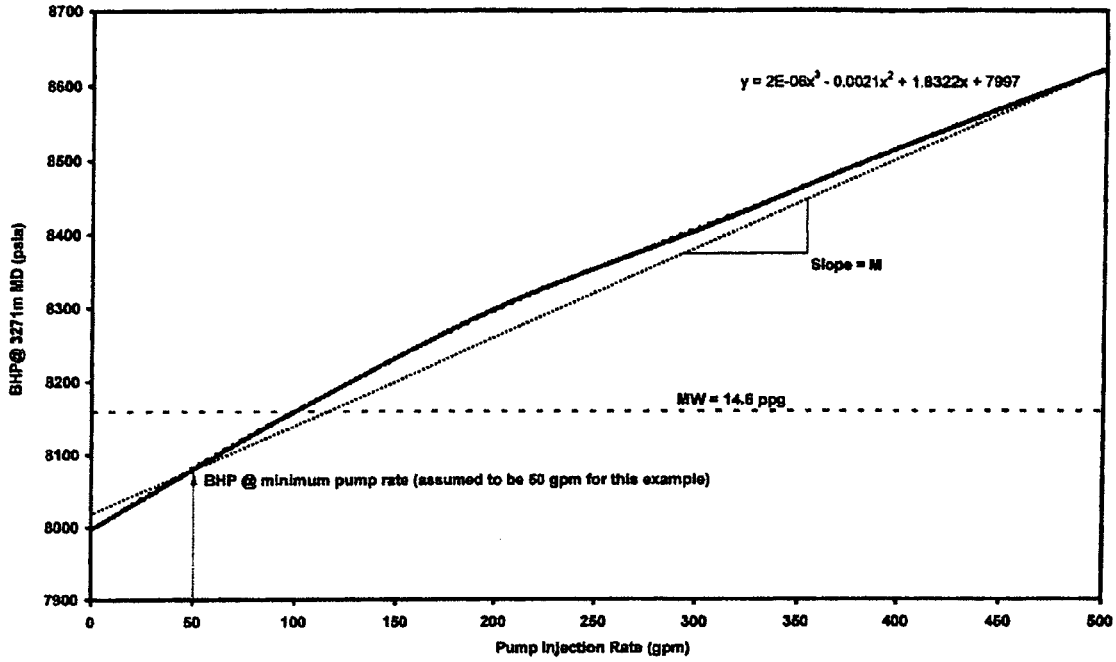
FIG. 4*a* is a graph showing the relationship between pump injection rate and bottom hole pressure at a given depth.

The graph shown in FIG. 4*a* illustrates an example of the relationship between equivalent circulating density and flow rate for a sample drilling fluid at a given depth. As indicated by the graph, this relationship can often be reasonably linear, having a slope M, which provides the following mathematical relationship:

$$P_{WH}=SP1+M(Q_{SP1}-Q);\text{ where,}$$

$P_{WH}$ is the desired wellhead pressure at injection rate Q; and $Q_{SP1}$ is in the injection flow rate at SP1; and, Q is the pump injection rate.

This relationship is preferably determined using real-time pressure-while-drilling (PWD), but can also be generated through a suitable hydraulics program on-site. If real-time PWD is available, hole pressure should be measured at the desired drilling flow rate and at the minimum pump rate and extrapolated to zero pump rate. If a more exacting correlation is desired, a minimum of one point between the desired drilling flow rate and the minimum pump rate can also be recorded. The decision concerning the necessity for a more exacting correlation will be a function of the drilling fluid properties and the sensitivity of the wellbore to pressure fluctuations. While quantative assessment of the approach required should be made for each job, in most cases it is expected that a relatively simple linear approximation will be sufficient.

A more exacting correlation can be determined by performing a "curve-fit" on the data points determined either through a hydraulics model or through real-time pressure measurement. For the example shown in FIG. 4, a polynomial equation can be fit to the data points.

$$\text{e.g. } P_{WH}=SP1+2\times10^{-6}(QSP1^3-Q^3)-0.0021(QSP1^2-Q^2)+1.8322(QSP1-Q)$$

Figure 4B:
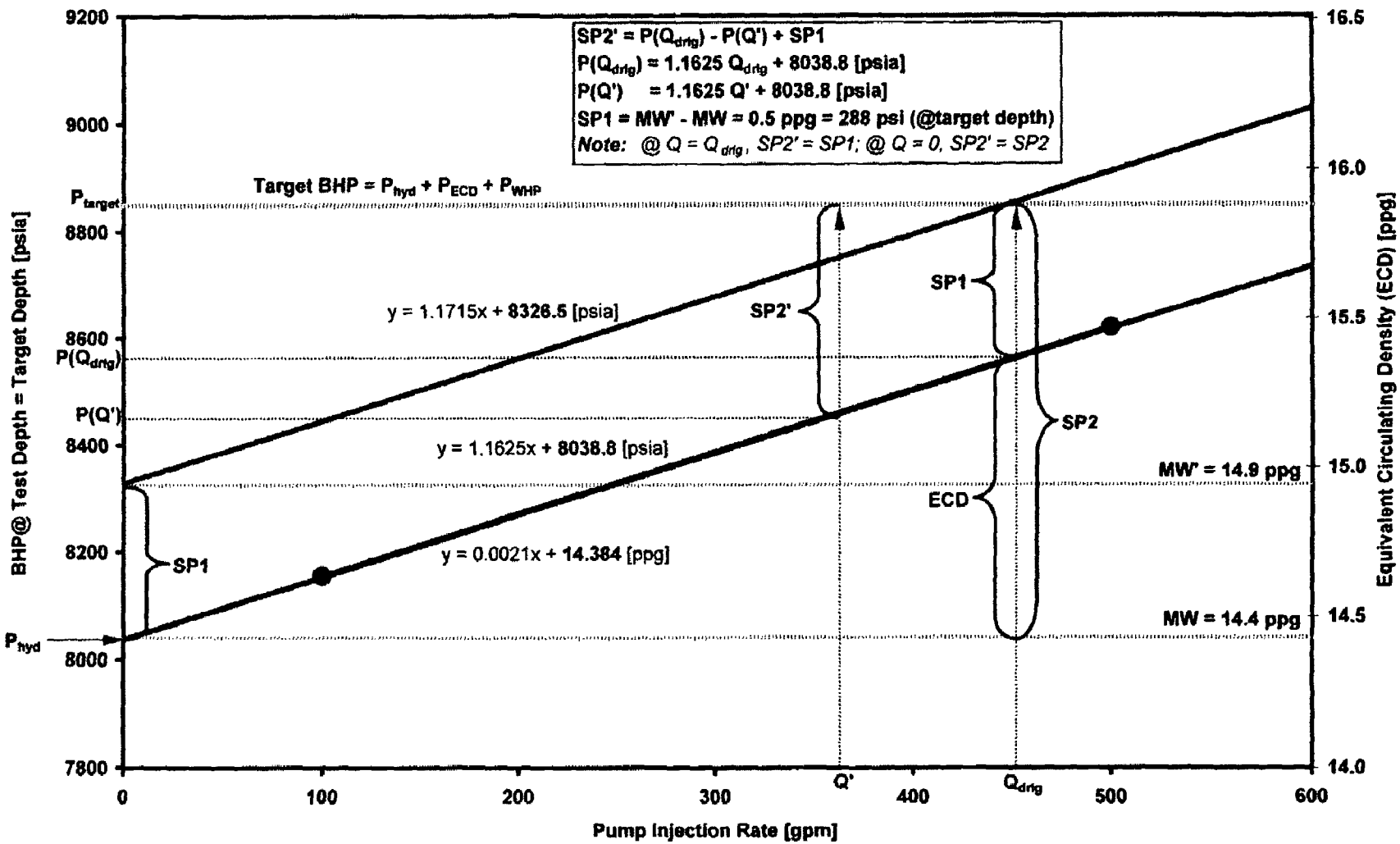
FIG. 4*b* is a more detailed variation of the graph shown in FIG. 4*a;*
Figure 4C:
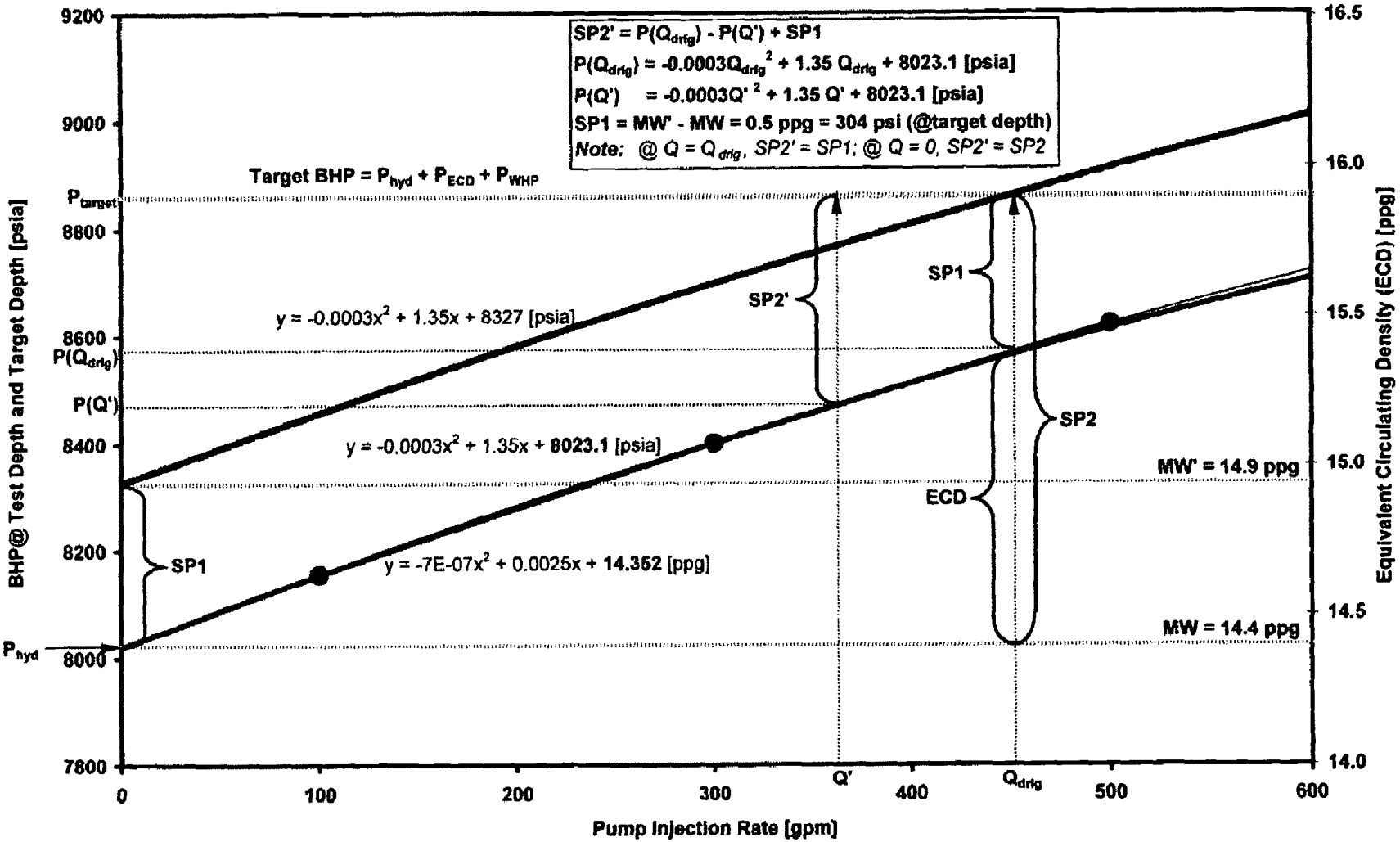
FIG. 4*c* is a further variation of the graph shown in FIG. 4*a;*

FIGS. 4*b* and 4*c* are more detailed variations of the graph shown in FIG. 4*a* that aid in further understanding the relationship between equivalent circulating density and flow rate. In the case of FIG. 4*b*, the relationship is represented as being linear (as in the case of FIG. 4*a*). In FIG. 4*c* the relationship is polynomial. In each Figure:

BHP is bottom hole or open hole pressure;

$P_{hyd}$ is hydrostatic pressure;

$P_{ECD}$ is pressure for equivalent circulating density (effectively friction pressure);

$P_{WHP}$ is wellhead pressure;

P(Q) is hole pressure at a given pump injection rate;

$P(Q_{drig})$ is hole pressure while drilling;

$P_{target}$ is the target bottom hole or open hole pressure while drilling;

Q is the pump injection rate;

$Q_{drig}$ is the pump injection rate while drilling; and,

MW is mud weight.

In FIGS. 4*b* and 4*c* two lines are shown to represent the relationship between equivalent circulating density and hole pressure where there is no wellhead pressure and where wellhead pressure is added. weights. As indicated in this example the addition of wellhead pressure has the essentially the same effect as increasing the mud weight from 14.4 to 14.9 pounds per gallon. That is, the graphs show how the addition of wellhead pressure can effectively create a phantom mud weight such that the well operates as if a mud having a higher weight is in use.

As shown, the relationship between drill string injection rate and open hole pressure is important when calculating the corresponding friction pressure. The friction pressure may be replaced with wellhead pressure to maintain a constant open hole pressure when mud flow stops.

It will also be appreciated that it is important to match the wellhead pressure with the corresponding drill string injection rate. This is generally the case during the process of shutting off the drilling fluid pumps to make a drill string connection or for any other purpose. While SP1 and SP2 are effectively the two "end-points", it is equally important to manage the transition from a "pumps-on" to a "pumps-off" situation (and vice versa) according to the relationship illustrated by the example shown in FIG. 4*a*, 4*b* and 4*c*.

Accordingly, a preferred procedure employed when shutting down the rig's main mud pumps involves first bringing on the auxiliary fluid pumps to pump across the wellhead and stabilizing the wellhead pressure before slowly bringing the drill string injection pumps offline. The main pumps should then be brought offline at a rate suitable to allow the wellhead pressure to replace the friction pressure. The most critical parameters are the speed of transmission of the pressure wave through the drilling fluid medium and the speed of reaction of the wellhead pressure control system, whether it be manual or automated. Appropriate values for set points SP1 and SP2 may be calculated by a controlled pressure drilling engineer on site, or may be determined remotely and provided to onsite personnel. It is contemplated that a chart similar to FIG. 4*a* will be generated periodically (for example at every rig shift change) in order to accommodate changes in drilling and formation conditions over time. Once a relationship similar to that shown in FIG. 4*a* has been established, and after SP1 and SP2 have been calculated, the transition from a pumps on to a pumps off situation (and vice versa) can be determined.

In a further aspect of the invention there is provided the ability to minimize the effect of surge and swab pressures caused by the movement of the drill string. That is, movement of the drill string into or out of the well will have an effect on open hole pressure to the point that the pressure may exceed or drop below a desired range. Specifically, when the string is advanced or lowered into the well the pressure will have a tendency to be increased through a surge effect. Similarly, hole pressure will tend to decrease on account of a swabbing effect when the string is retracted or lifted from the well. Generally, surge and swab pressure effects are much more significant in underbalanced drilling than in overbalanced drilling. However, through the utilization of the present invention the influence of a surge and/or a swab upon open hole pressure can be minimized by adjusting of the "effective" circulation rate (or effective mud weight) to account for the displacement of the drill string.

The relationship of the surge or swab flow rate can be defined as follows:

$$Q_{surge/swab}=Q+V_{dp}*dD/dt;\text{ where,}$$

Q is the pump injection rate;

$V_{dp}$ is the drill pipe displacement; and, dD/dt is the rate of pipe movement (+surge, −swab)

It will be appreciated that the adjustment of the "effective" circulation rate can be accomplished through either adjusting the mud pump rate and/or by applying surface pressure control (to essentially adjust the effective mud weight). Accordingly, in one embodiment of the invention adjusting the "effective" circulation rate involves an increase in the circulation rate to combat swab pressure and decrease in the circulation rate to combat surge pressure. In an alternate embodiment wellhead pressure applied to the annulus may be decreased to accommodate surging effects and increased to accommodate swabbing effects. While either method of adjusting the "effective" circulation rate can be used to maintain a stable pressure regime, in general making adjustments to the pump rate will be more effective for controlling short-term transient effects (such as surge and swab pressures) since doing so minimizes the lag time effect that occurs when surface pressure control is applied.

Figure 5:
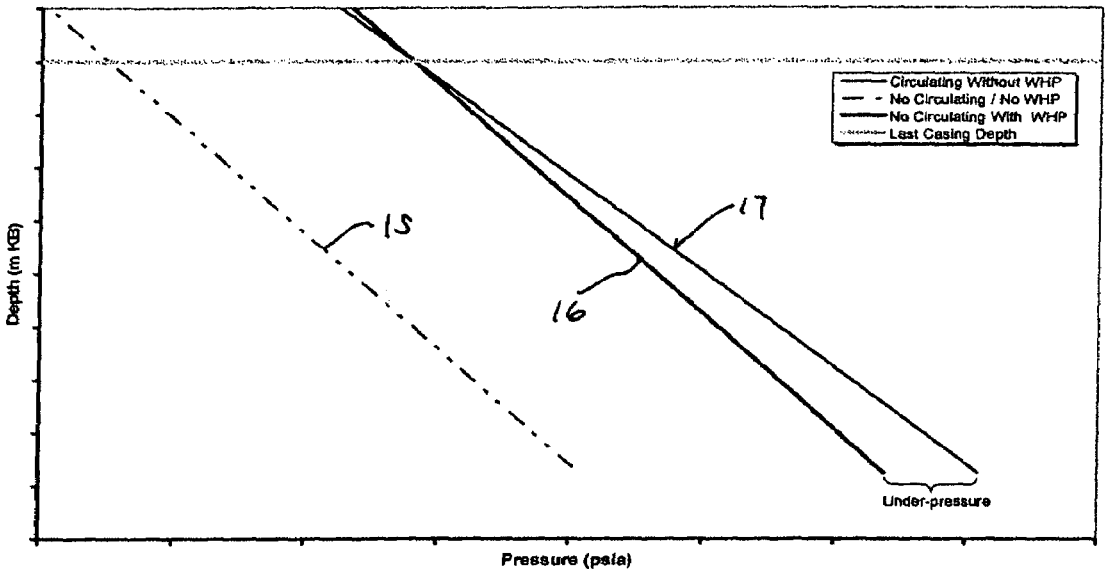
FIG. 5 is a graph depicting the general relationship between hole pressure and depth, under circulating and non-circulating situations, with and without wellhead pressure control, where the target hole pressure without circulation is controlled with surface pressure to match hole pressure at the shoe while circulating; and, FIG. 6 is a graph depicting the general relationship between hole pressure and depth, under circulating and non-circulating situations, with and without wellhead pressure control, where the target hole pressure without circulation is matched to the hole pressure while circulating at all depths.
Figure 6:
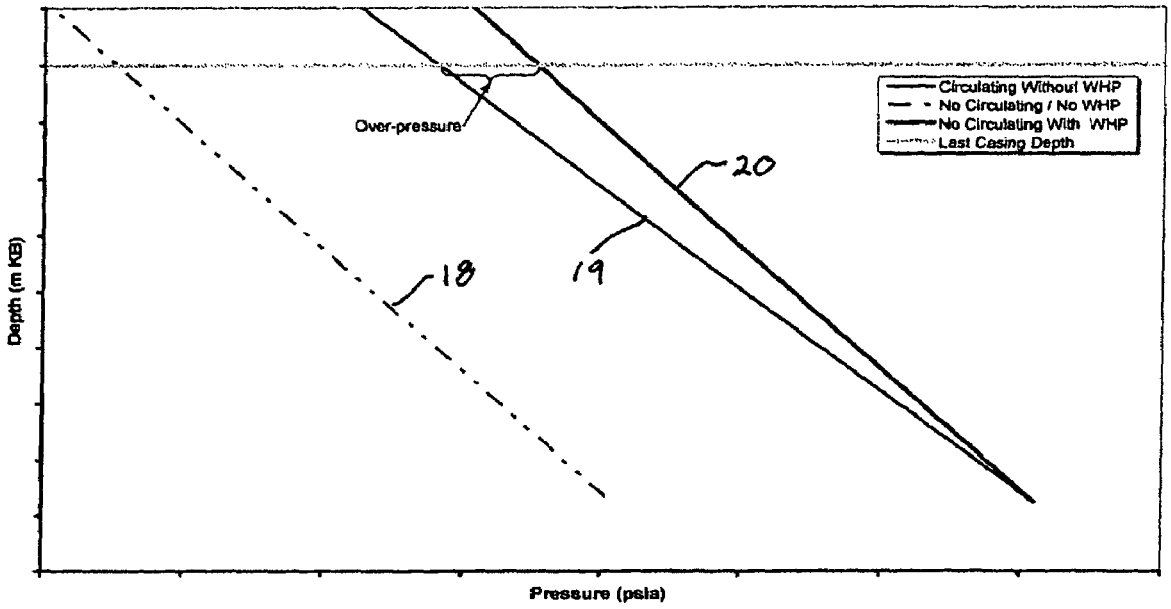

FIGS. 5 and 6 graphically represent two general approaches to the control of open hole pressure that may be utilized under the present invention. In FIG. 5 hole pressure without circulation is controlled with wellhead pressure to match the pressure at the shoe while circulating. Here line 15 represents pressure as a function of depth for a non-circulating well with no wellhead pressure. Line 16 represents a situation with no circulation, and with wellhead pressure. Line 17 represents a situation where there is circulation but no wellhead pressure. As is apparent from the graph, lines 16 and 17 will cross at the last casing depth or shoe, and diverge thereafter resulting in an under-pressure situation at or near the bottom of the well.

In contrast, if the target bottom hole pressure without circulation is matched to the bottom hole pressure while circulating at all depths, there will be a resulting over-pressure at shallow depths up to the casing shoe. This is demonstrated by FIG. 6 where line 18 represents a situation with no circulation and no wellhead pressure, line 19 represents a situation with circulation but no wellhead pressure, and line 20 represents a situation with no circulation but with wellhead pressure applied. As shown, lines 19 and 20 converge and meet at or near the bottom of the hole, resulting in an over-pressure condition at the shoe. The approach shown in FIG. 6 will be operationally more complex than that shown in FIG. 5, since the wellhead or back pressure will require constant modification as the depth of the borehole increases. However, it should also be appreciated that matching target bottom hole pressure without circulation to bottom hole pressure while circulating, as in the case of FIG. 6, permits wellhead pressures to be modified at any depth in order to define the fracture gradient at a particular depth and to permit control of pressures over the full open interval of the hole.

The general manner of operational control that may be exercised over open hole pressure will now be discussed with reference to the various embodiments of the invention described herein.

Depending upon the nature of the drilling operations at hand, in one of the preferred embodiments of the present invention wellhead pressure control choke 10 is provided with either two or three operating modes or positions for its adjustable orifice. The choke will have a first operating position corresponding to set-point 1 (SP1), where its degree of restriction provides wellhead pressure at a level that is desired during circulation to give the effect of a higher equivalent mud weight and to maintain hole pressure at or near a desired level. The choke will also preferably have a second operating position corresponding to set-point 2 (SP2), where its degree of restriction provides wellhead pressure necessary to replace the loss of friction pressure when circulation stops. Further, the wellhead pressure control choke may have a third operating position representing a manual override that permits an operator to manually adjust the choke, as necessary, in order to accommodate particular or unexpected well conditions. In some instances it may also be desirable to incorporate into choke 10 a fourth operating position (set-point 3 or SP3) corresponding to a wellhead pressure that is generally equivalent to the maximum allowable casing pressure, or the maximum allowable pressure for the rotating blow out preventor or choke manifold. The choke would only be operated at set-point 3 in the event of an excessively large influx or kick, and would serve to apply a maximum wellhead pressure (without exceeding safety limits upon the wellhead equipment) in an effort to contain the well and prevent a blow out.

The control of the above described wellhead pressure system will largely be a function of the automation or manual adjustment of wellhead pressure control choke 10 between its various set points and/or manual override positions. In one embodiment, the wellhead pressure system may be controlled according to set-point 1 and set-point 2 by manually selecting either "SP1" or "SP2", and with the option of switching the choke to a manual override position. Alternatively, movement of the choke between positions SP1 and SP2 may be accomplished through the use of an automated system that monitors wellhead pressure and/or pump rates and/or drilling fluid flow rates. Such an automated system may include any one of a very wide variety of available mechanical, hydraulic, pneumatic or electromechanical methods and devices that may be used to alter the orifice size in an adjustable choke in response to changes in operating parameters.

As indicated previously, when employing the present invention a particular procedure should be utilized when shutting down the drilling fluid pumps (i.e. moving from SP1 to SP2 when making a drill string connection or for a variety of other reasons). Traditionally, in such cases the fluid or mud pumps would merely be turned off. However, before shutting down the pumps a higher weighted mud is typically circulated through the well so that the added hydrostatic pressure of the heavier mud will offset the loss of friction pressure when the pumps are shut down and well control may be retained. With the above described pressure control system is in place the auxiliary fluid pump can first be brought on line to establish a desired level of wellhead or back pressure. Once the auxiliary pump has been started the mud or rig pumps can then be shut down (for example, over a span of from ten to thirty seconds) as the auxiliary pump rate and/or choke 10 are adjusted in order to apply an appropriate level of wellhead pressure to compensate for a decrease (and the eventual loss) of friction pressure as circulation slows and finally stops. In this manner well control is maintained without the need to calculate an enhanced mud density, without the need to add weighting agents to the mud, and without the need to circulate the weighted mud through the well. Controlling the rate at which the rig pumps are shut down in this manner also permits the pressure wave created through the activation of the auxiliary pumps to make its way gradually to the bottom of the hole. The control system is thereby effectively "ramped up" while the rig pumps are "ramped down" in order to maintain a consistent level of well pressure and well control. Typically the ramping up and down of the rig pumps would be a timed procedure or based on a incremental pump rate.

In a similar fashion, when starting the rig pumps (i.e. moving from SP2 to SP1) the reverse procedure is employed wherein the rig pumps are slowly ramped up as the auxiliary pump is shut down so that the establishment of friction pressure is balanced against the removal of wellhead pressure applied by the auxiliary pump. This manner of moving from SP1 to SP2, and conversely from SP2 to SP1, may be accomplished either manually by an operator or automatically through the use of an automated control system. The described procedure also eliminates the need to circulate weighted mud out of the well that would traditionally have been added to maintain well control during pump shut down, and the subsequent step of cleaning the weighted mud before it is allowed to return to the main rig tanks.

In another embodiment of the invention, automated wellhead pressure control may be obtained through cycling the wellhead pressure control choke 10 between set-point 1 and set-point 2, while at the same time monitoring wellhead pressure and pump rate. It will be appreciated that the pump rate may be monitored by means of either a flow meter or a stroke counter, however, in most instances it is expected that a stroke counter will be the preferred choice. In this embodiment the wellhead pressure system will preferably have two modes of operation; namely, a normal automatic operating mode which automatically cycles the choke between set-point 1 and set-point 2 (as required under circulating and non-circulating conditions), and a manual override where an operator can adjust the choke either above or below the limits of set-point 1 and set-point 2 to accommodate particular drilling situations.

As mentioned, the invention also provides for enhanced wellhead pressure control with the addition of mud pump rate control and/or through adjusting controlled pressure choke 10 to account for surge and/or swab pressure effects. An enhanced control system may be operated through monitoring wellhead pressure, pump rate and bit depth. The rate of advancement and retraction of the drill string can thus be monitored to permit an adjustment to the pump rate and/or wellhead pressure to accommodate surge and swab effects. The enhanced control in these regards preferably has three modes of operation; namely, a normal operating position, a normal operating position with surge and swab pump rate and/or choke adjustment, and a manual override control position. Both the normal operating and the normal operating with surge and swab adjustment positions may be configured to automatically adjust between a circulating and non-circulating situation.

A fourth general manner of operating the wellhead pressure system of the present invention provides three modes of operation; namely, a normal automatic operating mode, a manual over-ride mode, and a kick circulation mode. Under this method of operation the normal operating mode automatically shifts or cycles between set-point 1 and set-point 2 to accommodate circulating and non-circulating conditions. As mentioned above, a variety of different sensors or meters may be used to determine whether the well is under a circulating or non-circulating condition. Automatic mechanical, hydraulic, pneumatic or other means may then be employed to cycle the wellhead pressure control choke between SP1 and SP2. The automatic operating mode may also include accommodations to handle surge and swab effects, as also discussed above. Once again, the manual over-ride permits an operator to manually adjust the choke to accommodate particular, unusual or unexpected well conditions that may be encountered. Engaging the kick circulation mode requires manual intervention to switch from the normal operating mode to kick circulation, where the control parameters are switched from wellhead pressure and pump rate to standpipe pressure. Monitoring standpipe pressure enables the application of wellhead pressure at maximum safe limits while circulating out the fluid influx or kick. When the system is switched to a kick circulation mode, valve 12 should be opened and valve 11 closed in order to direct the influx of fluid through separator 8. To ensure that the influx is not allowed to escape, and to also ensure that it is not sent directly to rig tank 6, in the preferred embodiment valve 12 is automatically opened and valve 11 automatically closed upon moving to the kick circulation mode. While the kick is being circulated out the wellhead pressure can be modified by the rig operator as necessary under the circumstances. Typically the rig would also be equipped with alarms to ensure that neither the maximum rotating blowout preventor pressure nor the maximum allowable casing pressure is exceeded. Should either pressure exceed limitations, the rig's blowout preventors should be activated and conventional well control procedures put in place.

In a further aspect the operation of the wellhead pressure system of the present invention may include a bias control (noted generically by reference numeral 30 on FIGS. 2 and 3) that permits an operator to manually increase the amount of wellhead pressure that is applied by a fixed percentage or a fixed amount. The intent of the bias control is to present an operator with the opportunity to increase wellhead pressure by a fixed amount in a relatively quick manner so as to provide a means of helping to accommodate a sudden influx or kick, until there is sufficient time to more precisely determine the amount of pressure needed to be applied in order to safely circulate out the kick. The bias control may take any one of a wide variety of different forms, however, it is expected that in most instances it will merely be a simple button, dial or slide that may be easily and quickly operated when necessary. The button, dial or slide may be electrically, hydraulically, pneumatically or mechanically connected to a shuttle valve configured to increase wellhead pressure applied to the annulus. Alternatively, the bias control may be linked to choke 10 such that its operation alters the size of the adjustable orifice in the choke. In a further embodiment of the invention the bias control may be linked to the supply of fluid pumped across the wellhead such that activation of the bias control causes an increase in the volume of fluid delivered to the wellhead and a resulting increase in wellhead pressure applied to the annulus.

Regardless of the particular structure of the bias control, once activated it effectively increases wellhead pressure applied by the system by a pre-determined percentage or absolute amount (for example 5, 10, 15, 20, 25 percent etc.). The ability to quickly apply an enhanced level of pressure to the wellhead when a kick is incurred, provides an operator with additional time within which to determine the nature and size of the kick, and to more accurately calculate the actual additional pressure that is required. Once the kick has been circulated out, the bias control can be placed back into its inactivated position so that it is once again available for immediate use if the need arises. It will be appreciated that the nature of the drilling operations at particular sites will determine the optimal amount of additional pressure that should be available to an operator through activation of the bias control, and that the amount of additional pressure available in these regards may vary from site to site and from job to job.

Through a complete understanding of the present invention it will be appreciated that the method described herein provides a mechanically simplified manner of dynamically controlling open hole and bottom hole pressure in a wellbore. Hole pressure is controlled through the application of wellhead pressure that provides the effect of a higher equivalent mud weight without the need to utilize density enhancers. The method also provides for the ability to control hole pressure with minimal interference to conventional rig equipment and, where feasible, through the use of conventional rig equipment that is in many cases already available on site. With its own dedicated wellhead pressure control choke the method may be operated separately from the drilling fluid circulation system and does not rely upon or utilize the rig choke. The method further minimizes the need to increase personnel requirements, which is particularly attractive in off shore drilling environments. The process provides for a simple determination of set-points 1 and 2, which correspond to circulating and non-circulating conditions, and allows for a simple mechanical, pneumatic, hydraulic or electromechanical automation of the control system. In addition, through adjustments made to the circulation rate and/or the wellhead pressure applied to the annulus the method is able to accommodate the effects of surging and swabbing as the drill string is advanced or retracted from the well. The simple control strategy also promotes acceptance by rig operators by eliminating the "black box" effect that complex microprocessor and computer systems often invoke. The addition of a bias control enhances rig safety when a sudden influx or kick is encountered.

The above described method further permits an operator to easily and quickly determine the effects of increasing or decreasing mud weight upon the well. Under current systems where an operator wants to increase or adjust the mud weight, a new mud weight has to be calculated and mixed and then injected into the drill string. If the new weight does not achieve the desired effects the process has to be repeated until a proper weight is determined. Such processes are not only time consuming but costly. Under the pressure control system of the present invention the open hole pressure can be adjusted to give the effect of a "phantom" mud weight. The reaction of the well to the "phantom" mud weight can then be monitored to determine whether an actual equivalent mud weight would be satisfactory. Adjustments to the phantom mud weight can be made quickly and easily without incurring the costs of utilizing extensive density enhancers and without the associated labour and lost time costs. Once the optimum phantom mud weight has been determined, that actual mud weight can be mixed and injected into the well with the confidence of knowing how the well will react to the new mud weight. Accordingly, the system allows for the fast, simple and inexpensive testing of how a well will react to new mud weights. In a further variation, the bias control described above may be momentarily activated to determine how the well would react to an increase in effective mud weight by a fixed amount or percentage.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A method of dynamically controlling open hole pressure within a wellbore having a drill string positioned therein, the method comprising the steps of:

(i) pumping a fluid down the drill string, into an annulus formed by the drill string and the interior of the wellbore, and then subsequently up the annulus to the surface of the ground, said fluid exiting said annulus and directed through a drilling rig choke to control the flow of fluid from the wellbore;

(ii) selectively applying wellhead pressure to the annulus through selectively pumping an additional quantity of the fluid or a quantity of a secondary fluid across the annulus; and, (iii) controlling the application of wellhead pressure applied to the annulus by controlling the operation of a wellhead pressure control choke, said wellhead pressure control choke operated and connected to said annulus independent from said drilling rig choke, to thereby maintain open hole pressure within a desired range without adjusting said drilling rig choke.

2. The method as claimed in claim 1 including the step of decreasing the rate of pumping fluid down the drill string to combat surge effects created when the drill string is advanced within the wellbore.

3. The method as claimed in claim 1 including the step of increasing the rate of pumping fluid down the drill string to combat swab effects created when the drill string is lifted within the wellbore.

4. The method as claimed in claim 1 including the step of decreasing wellhead pressure applied across the annulus to accommodate surge effects created when the drill string is advanced within the wellbore.

5. The method as claimed in claim 1 including the step of increasing wellhead pressure applied across the annulus to accommodate swab effects created when the drill string is lifted within the wellbore.

6. The method as claimed in claim 1 wherein the wellhead pressure control choke has at least a first, a second and a third operating position, the first operating position corresponding to an orifice size that permits the application wellhead pressure across the annulus to maintain open hole pressure within a desired range when fluid is being pumped down through the drill string, the second operating position corresponding to an orifice size that permits the application of wellhead pressure across the annulus to maintain open hole pressure within a desired range when the pumping of fluid down the drill string stops, the third operating position representing a manual position wherein the degree of wellhead pressure applied across the annulus can be controlled manually.

7. The method as claimed in claim 1 wherein the wellhead pressure control choke has at least first and second operating positions, the first operating position corresponding to an orifice size that permits the application of wellhead pressure across the annulus to maintain open hole pressure within a desired range when fluid is being pumped down through the drill string, the second operating position representing a manual position wherein the degree of wellhead pressure can be controlled manually.

8. The method as claimed in claim 1 including the further step of directing the additional quantity of fluid or secondary fluid that is pumped across the annulus to rig mud tanks when the fluid or secondary fluid has a hydrocarbon gas content below a pre-determined range, and directing the additional quantity of fluid or secondary fluid that is pumped across the annulus to a separator when the fluid or secondary fluid contains levels of hydrocarbon gas beyond said pre-determined range.

9. The method as claimed in claim 1 wherein the wellhead pressure control choke has at least first, second and third operating positions, the first operating position corresponding to an orifice size that permits the application of wellhead pressure across the annulus to maintain open hole pressure within a desired range when fluid is being pumped down through the drill string, the second operating position corresponding to the first operating position and permitting a decrease in wellhead pressure applied across the annulus to accommodate surge effects when the drill string is advanced within the wellbore and an increase in wellhead pressure applied across the annulus to accommodate swab effects when the drill string is lifted within the wellbore, the third operating position representing a manual position wherein the wellhead pressure applied across the annulus can be controlled manually.

10. The method as claimed in claim 1 wherein the wellhead pressure control choke has at least first, second, third and fourth operating positions, the first operating position corresponding to an orifice size that permits the application of wellhead pressure across the annulus to maintain open hole pressure within a desired range when fluid is being pumped down through the drill string, the second operating position corresponding to the first operating position and permitting a decrease in wellhead pressure applied across the annulus to accommodate surge effects when the drill string is advanced within the wellbore and an increase in wellhead pressure applied across the annulus to accommodate swab effects when the drill string is lifted within the wellbore, the third operating position permitting the application of a fixed and elevated level of wellhead pressure applied across the annulus, the fourth operating position representing a manual position wherein the degree of wellhead pressure applied across the annulus can be controlled manually.

11. The method as claimed in claim 1 including the step of providing a means for the selective and rapid application of a fixed and elevated level of wellhead pressure to the annulus to cause an increase in open hole pressure.

12. The method as claimed in claim 1 including the step of directing the additional quantity of fluid or secondary fluid that is pumped across the annulus, and then discharged therefrom, to rig mud tanks when the fluid or secondary fluid has a hydrocarbon content below a pre-determined value, and directing the additional quantity of fluid or secondary fluid to a separator when the fluid or secondary fluid contains levels of hydrocarbon above a pre-determined value.

13. The method as claimed in claim 12 wherein the direction of the additional quantity of fluid or secondary fluid to either the rig mud tanks or to a separator is accomplished with the assistance of a pair of interlocked valves.

14. The method as claimed in claim 1 including the step of directing the additional quantity of fluid or secondary fluid that is pumped across the annulus, and then discharged therefrom, to rig mud tanks when the fluid or secondary fluid has a hydrocarbon content below a pre-determined value, and directing the fluid or secondary fluid to a separator when the fluid contains levels of hydrocarbon beyond a pre-determined value.

15. The method as claimed in claim 14 wherein the direction of the additional quantity of fluid or secondary fluid to either the rig mud tanks or to a separator is accomplished with the assistance of a pair of interlocked valves.

16. A method of controlling open hole pressure in a wellbore having positioned therein a drill string through which fluid is pumped down into the wellbore, said fluid subsequently moving up the annulus formed by the drill string and the interior of the wellbore and exiting the annulus through a drilling rig choke, the method comprising the steps of:

(i) selectively applying wellhead pressure to the annulus formed by the drill string and the interior of the wellbore by selectively pumping an additional quantity of the fluid or a quantity of a secondary fluid across the annulus;

(ii) controlling the application of said wellhead pressure applied to said annulus through operating a dedicated wellhead pressure control choke connected to said annulus;

(iii) accommodating surge effects created when the drill string is advanced within the wellbore by decreasing the rate of pumping fluid down the drill string; and, (iv) accommodating swab effects created when the drill string is lifted within the wellbore by increasing the rate of pumping fluid down the drill string.

17. The method as claimed in claim 16 wherein the rate of advancement and retraction of the drill string is monitored and the rate of pumping fluid down the drill string is adjusted to accommodate swab and surge effects.

18. A method of controlling open hole pressure in a wellbore having positioned therein a drill string through which fluid is pumped down into the wellbore, said fluid subsequently moving up the annulus formed by the drill string and the interior of the wellbore and exiting the annulus through a drilling rig choke, the method comprising the steps of:

(i) selectively applying wellhead pressure to the annulus formed by the drill string and the interior of the wellbore by selectively pumping an additional quantity of the fluid or a quantity of a secondary fluid across the annulus;

(ii) controlling the application of said wellhead pressure applied to said annulus through operating a dedicated wellhead pressure control choke connected to said annulus;

(iii) accommodating surge effects created when the drill string is advanced within the wellbore through decreasing the wellhead pressure applied across the annulus; and, (iv) accommodating swab effects created when the drill string is lifted within the wellbore through increasing wellhead pressure applied across the annulus.

19. The method as claimed in claim 18 wherein the rate of advancement and retraction of the drill string is monitored and the application of wellhead pressure across the annulus adjusted to accommodate swab and surge effects.

20. The method as claimed in claim 18 wherein said wellhead pressure control choke has at least a first and a second operating position, when in its first operating position the control choke permitting the application of wellhead pressure across the annulus at a level that maintains open hole pressure within a desired range when fluid is circulating through the drill string, when in its second operating position the control choke permitting the application of wellhead pressure across the annulus at a level sufficient to maintain open hole pressure within a desired range when the pumping of fluid down the drill string stops.

21. The method as claimed in claim 20 wherein the wellhead pressure control choke moves automatically between its first and second operating positions in accordance with the circulation or non-circulation of fluid through the drill string.

22. A method of dynamically controlling open hole pressure within a wellbore, the wellbore having therein a drill string through which a fluid is pumped down into the wellbore, said fluid subsequently moving up the annulus formed by the drill string and the interior of the wellbore and exiting the annulus through a drilling rig choke, the method comprising the steps of:

a. selectively applying wellhead pressure to the annulus formed by the drill string and the interior of the wellbore by selectively pumping a quantity of said fluid or a secondary fluid across the annulus;

b. controlling the application of wellhead pressure applied to the annulus by controlling one, or both, of (a) the operation of a dedicated wellhead pressure control choke connected to said annulus, and (b) the flow rate of the fluid or secondary fluid pumped across the annulus; and, c. providing a means for the application of a fixed and elevated level of wellhead pressure to the annulus to cause an increase in the open hole pressure by a fixed and pre-determined percentage or amount.

23. The method as claimed in claim 22 wherein said means for the application of a fixed and elevated level of wellhead pressure to the annulus comprises a bias control, said bias control permitting a selective and rapid application of an increase of from 5 to 25 percent in wellhead pressure applied to the annulus.

24. The method as claimed in claim 23 wherein said means for the selective and rapid application of a fixed and elevated level of wellhead pressure to the annulus comprises a bias control, said bias control permitting a selective and rapid application of an increase of from 5 to 25 percent in wellhead pressure applied to the annulus.

25. A method of dynamically controlling open hole pressure within a wellbore having therein a drill string through which a fluid is pumped down into the wellbore, said fluid subsequently moving up the annulus formed by the drill string and the interior of the wellbore and exiting the annulus through a drilling rig choke, the method comprising the steps of:

(i) selectively applying pressure to the annulus formed by the drill string and the interior of the wellbore by selectively pumping a quantity of said fluid or a secondary fluid across the annulus;

(ii) controlling the application of pressure applied to the annulus by controlling one, or both, of (a) the operation of a dedicated wellhead pressure control choke connected to said annulus, and (b) the flow rate of the fluid or secondary fluid pumped across the annulus;

(iii) increasing the level of applied pressure to give the effect of a higher density fluid being pumped down the drill string; and, (iv) monitoring wellbore conditions to determine the effective result of pumping a higher density fluid down the drill string without an actual change in the density of the fluid.

26. A method of dynamically controlling open hole pressure within a wellbore having therein a drill string through which a fluid is pumped down into the wellbore, said fluid subsequently moving up the annulus formed by the drill string and the interior of the wellbore and exiting the annulus through a drilling rig choke, the method comprising the steps of:

(i) controlling the application of a wellhead pressure applied to the annulus, formed by the drill string and the interior of the wellbore, through the operation of a dedicated wellhead pressure control choke connected to said annulus;

(ii) increasing the level of applied wellhead pressure to give the effect of a higher density fluid being pumped down the drill string; and, (iii) monitoring wellbore conditions to determine the effective result of pumping a higher density fluid down the drill string without an actual change in the density of the fluid.

27. A method of controlling pressure within a wellbore having a drill string positioned therein, the method comprising the steps of:

(i) circulating drilling fluid down the drill string, up an annulus created between the drill string and the wellbore, out of the wellbore through a wellhead, and through a first choke while advancing the drill string into the wellbore; and, (ii) pumping drilling fluid or a quantity of a secondary fluid into the wellhead and then through a wellhead pressure control choke to control pressure in the wellbore.

28. The method as claimed in claim 27 including the further step of continuing to pump drilling fluid or a quantity of a secondary fluid into the wellhead and through said wellhead pressure control choke to control pressure in the wellbore when the advancement of the drill string within the wellbore ceases.

29. The method as claimed in claim 27 wherein said first choke and said wellhead pressure control choke are independently operable.

30. The method as claimed in claim 27 wherein said wellhead pressure control choke has at least first and second operating positions, the first operating position permitting the application of pressure to the wellhead in order to maintain wellhead pressure within a desired range when drilling fluid is circulated down the drill string, the second operating position permitting the application of pressure to the wellhead in order to maintain wellhead pressure within a desired range when the circulation of drilling fluid down the drill string stops.

31. The method as claimed in claim 30 wherein said wellhead pressure control choke has a third operating position, said third operating position permitting the selective and rapid application of an increase of from 5 to 25% in the pressure applied to said wellhead.

* * * * *